US007240783B2

(12) United States Patent
Draghetti et al.

(10) Patent No.: US 7,240,783 B2
(45) Date of Patent: Jul. 10, 2007

(54) UNIT FOR FEEDING FILTERS TO A FILTER ASSEMBLY MACHINE

(75) Inventors: Fiorenzo Draghetti, Medicina (IT); Andrea Montanari, Monte San Pietro (IT)

(73) Assignee: G.D Societá per Azioni, Bologna (IT)

( * ) Notice: Subject to any disclaimer, the term of this patent is extended or adjusted under 35 U.S.C. 154(b) by 225 days.

(21) Appl. No.: 10/913,227

(22) Filed: Aug. 6, 2004

(65) Prior Publication Data

US 2005/0066979 A1 Mar. 31, 2005

(30) Foreign Application Priority Data

Aug. 8, 2003 (IT) ..... BO2003A0491

(51) Int. Cl.
*B65G 1/00* (2006.01)
*B65G 37/00* (2006.01)
*B65G 47/26* (2006.01)
*B65G 47/00* (2006.01)

(52) U.S. Cl. ..... 198/418; 198/347.1; 198/452; 198/457.01

(58) Field of Classification Search ..... 198/418, 198/347.4, 347.1, 452, 597, 457.05, 457.06, 198/459.6, 448, 532, 540, 562; 131/88
See application file for complete search history.

(56) References Cited

U.S. PATENT DOCUMENTS 1,997,532 A * 4/1935 Molins ..... 198/441
3,519,143 A * 7/1970 David et al. ..... 414/792.5
3,957,156 A * 5/1976 Schwenke ..... 198/413
4,368,742 A * 1/1983 Wahle et al. ..... 131/88
4,420,073 A * 12/1983 Hausler et al. ..... 198/347.2
5,161,663 A * 11/1992 Cupp et al. ..... 198/347.2
5,556,236 A 9/1996 Seim, II et al.
5,735,381 A * 4/1998 Brizzi et al. ..... 198/370.07
6,368,041 B1 * 4/2002 Atwell et al. ..... 414/295
6,443,669 B2 * 9/2002 Saito ..... 406/28
6,540,061 B1 * 4/2003 Focke et al. ..... 198/359
6,598,728 B1 * 7/2003 Focke et al. ..... 198/418.6

FOREIGN PATENT DOCUMENTS

EP 0 682 881 11/1995
EP 0 689 775 1/1996
GB 1409814 10/1975
GB 2140379 11/1984

* cited by examiner

*Primary Examiner*—Gene O. Crawford
*Assistant Examiner*—Ramya G. Prakasam
(74) *Attorney, Agent, or Firm*—Marshall, Gerstein & Borun LLP

(57) ABSTRACT

A unit for feeding filters to a filter assembly machine, wherein at least one deflecting device receives a respective succession of filter portions in an axial direction, and feeds the filter portions to the filter assembly machine in a transverse direction crosswise to the filter portions; the deflecting device being defined by a fixed frame supporting an input and an output, and by an extractable box fitted movably to the fixed frame and supporting a first conveying device for conveying the filter portions in the axial direction, a second conveying device for conveying the filter portions in the transverse direction, and a deflecting member for diverting the filter portions to the transverse direction.

21 Claims, 5 Drawing Sheets

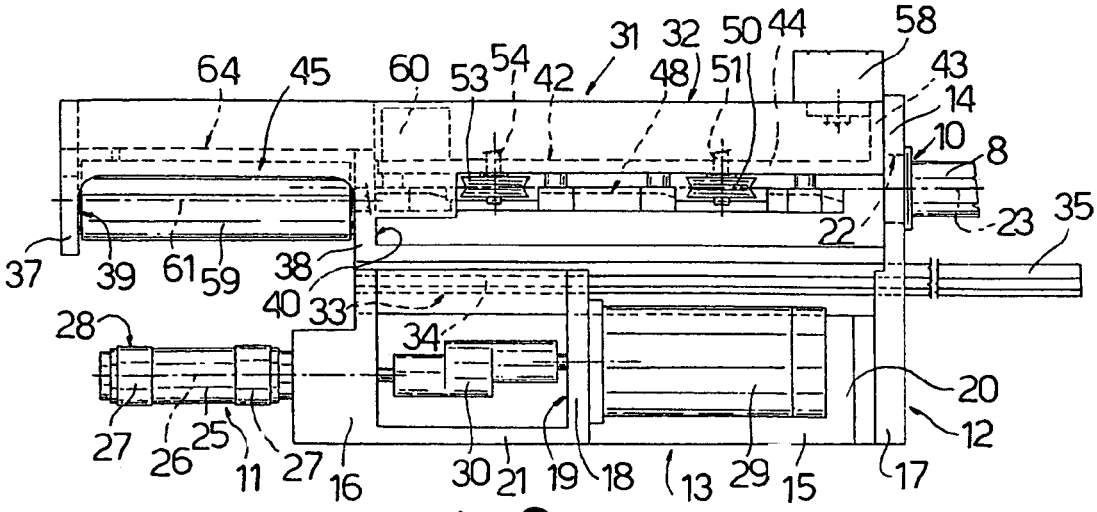
Fig.6
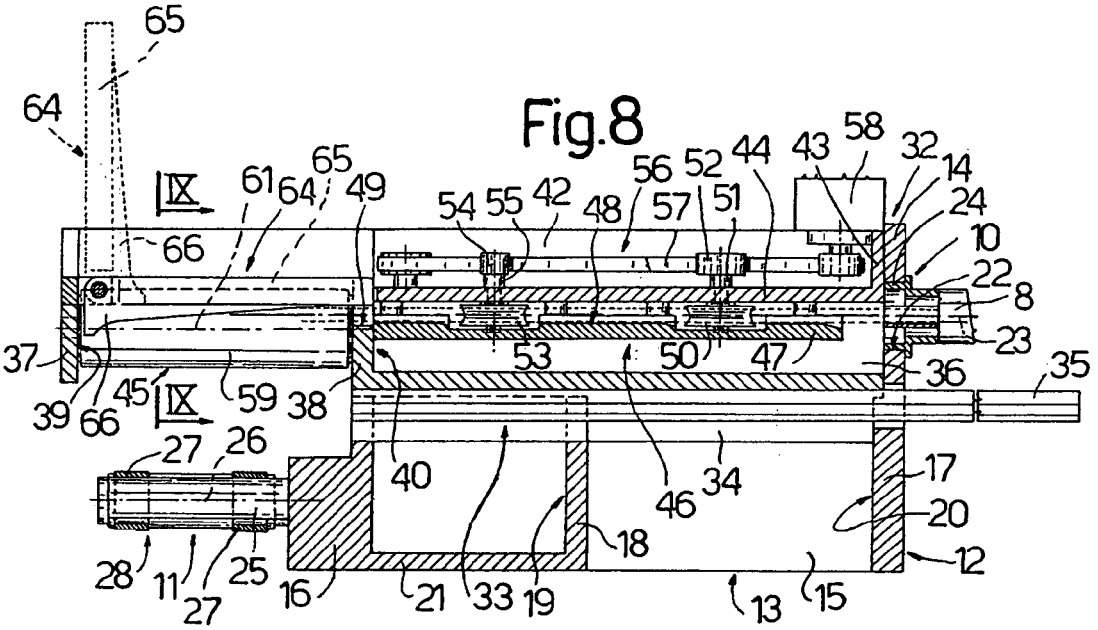
Fig.8
Fig.7
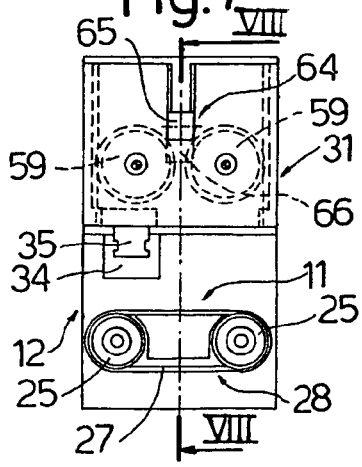
Fig.9
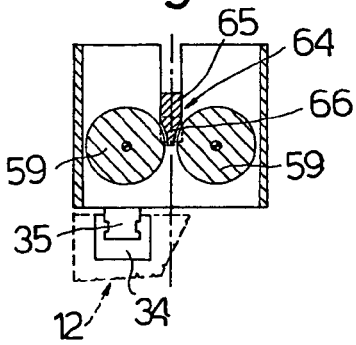

UNIT FOR FEEDING FILTERS TO A FILTER ASSEMBLY MACHINE

This application claims the benefit of Italian Patent Application Serial No. BO2003A 000491, filed Aug. 8, 2003.

The present invention relates to a unit for feeding filters to a filter assembly machine.

More specifically, the present invention relates to a unit for feeding filters to a filter assembly machine, the unit receiving at least one succession of filter portions travelling in a first axial direction, and feeding the filter portions to the filter assembly machine in a second direction crosswise to the filter portions; and the unit being of the type comprising a deflecting device having an input for receiving the succession of filter portions travelling in the first direction, and an output for the filter portions travelling in the second direction, and feed means for feeding the succession of filter portions to the input in the first direction.

BACKGROUND OF THE INVENTION

In a known unit of the type described above, the sharp change in the feed direction of the filter portions sometimes results in jams, the frequency of which is in direct proportion to the operating capacity of the filter assembly machine connected to the unit. Jams of this sort must obviously be cleared immediately, by not only blocking the filter feed unit, but also, in a relatively short space of time, the filter assembly machine connected to the unit.

On the other hand, known units of the type described are normally so complex in design as to make fast manual intervention by an operator from the outside difficult, so that jamming invariably involves considerable downtime and, very often, stoppage of the relative filter assembly machines.

SUMMARY OF THE INVENTION

It is an object of the present invention to provide a filter feed unit designed to eliminate the aforementioned drawbacks and permit relatively fast servicing.

According to the present invention, there is provided a unit for feeding filters to a filter assembly machine, as claimed in Claim 1 and, preferably, in any one of the following Claims depending directly or indirectly on Claim 1.

BRIEF DESCRIPTION OF THE DRAWINGS

A number of non-limiting embodiments of the present invention will be described by way of example with reference to the accompanying drawings, in which:

FIGS. 6 and 7 show, with parts removed for clarity, larger-scale side and front views respectively of the FIG. 3-5 detail in a closed operating position;

FIG. 8 shows a section along line IIX—IIX in FIG. 7;

FIG. 9 shows a section along IX—IX in FIG. 8;

DETAILED DESCRIPTION OF THE INVENTION

Figure 2:
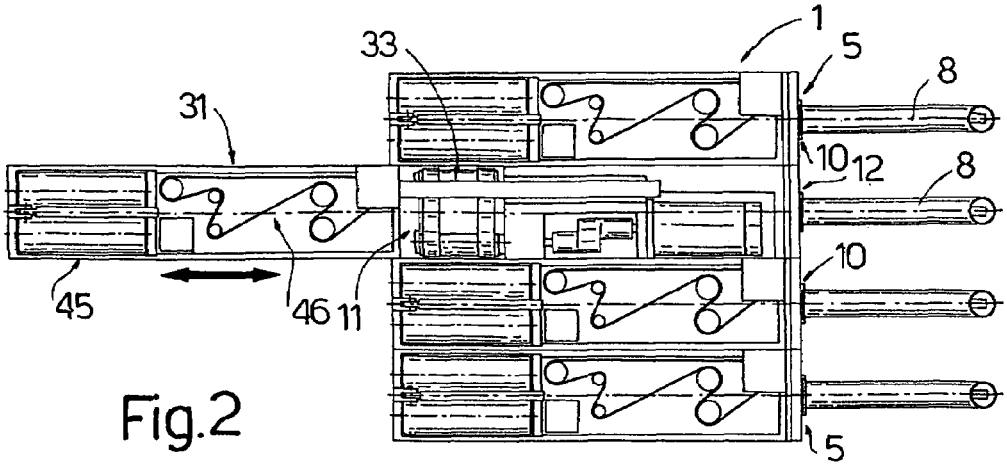
FIG. 2 shows a schematic, larger-scale plan view of a detail of FIG. 1.
Figure 1:
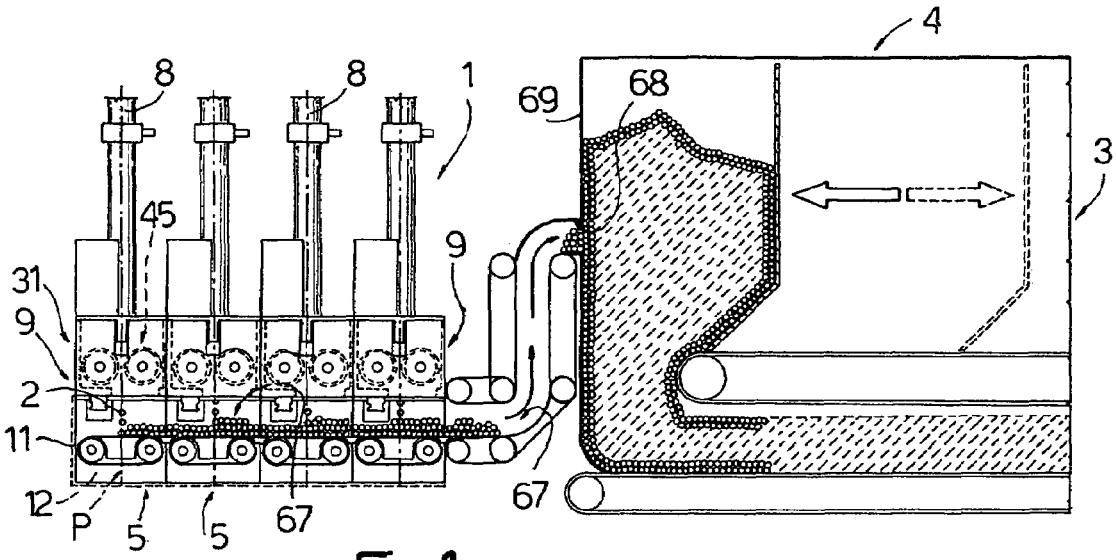
FIG. 1 shows a schematic front view of a first preferred embodiment of the filter feed unit according to the present invention.

Number 1 in FIG. 1 indicates as a whole a unit for feeding filter portions 2 to an input hopper 3 of a filter assembly machine indicated as a whole by 4.

Figure 10:
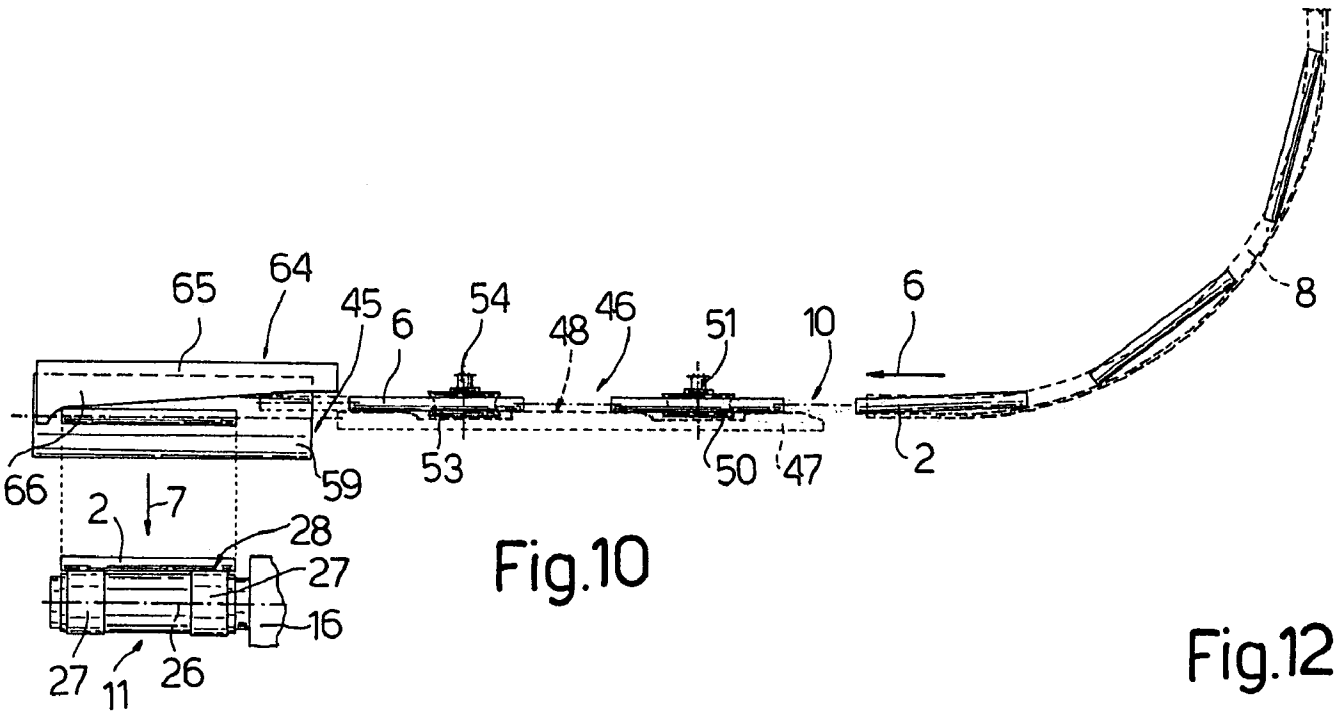
Figure 11:
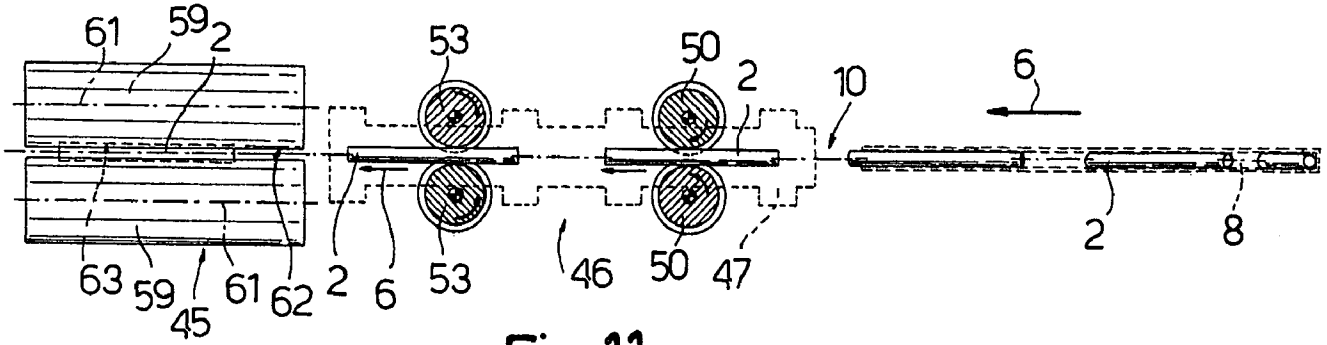

Unit 1 is a modular unit, and comprises a number of identical, side by side modules 5, each for receiving a relative succession of filter portions 2 travelling in an axial direction 6 (FIG. 10), and for feeding filter portions 2 to filter assembly machine 4 in a transverse direction 7 (FIG. 10) crosswise to filter portions 2.

It should be pointed out that, here and hereinafter, directions 6 and 7 are relative as opposed to absolute, and relate to the position assumed by the longitudinal axis of each filter portion 2 at each point along its feed path along relative module 5.

In the example shown, side by side modules 5 are four in number. In variations (not shown), however, a different number of modules 5, and even only one module 5, may be provided.

Each module 5 comprises a conduit 8 for pneumatically transporting filter portions 2 in axial direction 6; and a deflecting device 9, which comprises an input 10, through which filter portions 2 travel in direction 6 and which is connected to an output of conduit 8, and an output 11 for feeding filter portions 2 to hopper 3 in transverse direction 7.

As shown more clearly in FIGS. 3 to 8, each deflecting device 9 comprises a fixed, substantially L-shaped frame 12, in turn comprising a hollow base body 13 in the form of a rectangular parallelepiped having a horizontal longitudinal axis parallel to axial direction 6 in which filter portions 2 travel through input 10, and an end plate 14 extending upwards from one end of base body 13. Base body 13 comprises a longitudinal lateral wall 15; a front wall 16 and rear wall 17 perpendicular to and projecting laterally from lateral wall 15; and an intermediate partition 18 parallel to walls 16 and 17 and projecting from lateral wall 15 to divide the space between walls 16 and 17 into an open-sided front chamber 19 and an open-side rear chamber 20, of which front chamber 19 is closed at the bottom by a bottom wall 21, while rear chamber 20 is also open at the bottom.

End plate 14 is coplanar and integral with rear wall 17, and has a through hole 22 (FIG. 8) having an axis 23 which, together with the longitudinal axis of base body 13, defines a vertical plane P (FIGS. 3 and 5) parallel to lateral wall 15. Hole 22 houses a fitting 24 for connecting relative conduit 8 to frame 12, and, together with fitting 24, defines input 10 of deflecting device 9. Front wall 16 supports two projecting rollers 25 which are located to the front of front wall 16, have respective axes 26 of rotation parallel to axis 23, located on opposite sides of plane P, and lying in a plane perpendicular to plane P, and support two endless belts 27 which, together with rollers 25, define a conveyor 28 defining output 11 and driven by a motor 29, which is fitted to frame 12 inside rear chamber 20, and drives conveyor 28 via a transmission 30 fitted to frame 12 inside front chamber 19.

Above relative frame 12, each deflecting device 9 comprises a box 31, a frame 32 of which is connected to frame 12 by a known, preferably recirculating-ball-type, guide-slide coupling 33, which extends parallel to axis 23 and to direction 6, is located laterally with respect to plane P, and comprises a guide 34 integral with the top ends of front wall 16 and intermediate partition 18 of frame 12, and a slide 35 located beneath frame 32 and fitted in sliding manner to guide 34.

Frame 32 comprises a longitudinal lateral wall 36; a front wall 37; and an intermediate partition 38 parallel to front wall 37 and projecting from lateral wall 36 to divide the space between front wall 37 and a rear end of lateral wall 36 into an open-sided front chamber 39 and an open-sided rear chamber 40, of which front chamber 39 is open at the top and bottom, while rear chamber 40 is open at the top and closed at the bottom by a bottom wall 41, to the underside surface of which is integrally connected a longitudinal rod defining slide 35.

A top portion of rear chamber 40 houses a cup-shaped body 42 comprising a rear wall 43 perpendicular to axis 23 and located at the rear end of lateral wall 36; and a bottom wall 44 parallel to bottom wall 41 and located above axis 23.

Chambers 39 and 40 house a conveying device 45 and a conveying device 46 respectively; conveying device 46 receives filter portions 2 successively from input 10, and conveys them parallel to plane P in direction 6; and conveying device 45 receives filter portions 2 successively from conveying device 46, and feeds them in direction 7 to output 11.

Conveying device 46 comprises a slide plate 47 which is located inside rear chamber 40, is suspended beneath bottom wall 44 of cup-shaped body 42, and comprises a central longitudinal groove 48 coaxial with axis 23 and with a hole 49 (FIG. 8) formed through intermediate partition 38 and for guiding filter portions 2 travelling in direction 6.

Conveying device 46 also comprises two counter-rotating rollers 50 defined by grooved feed rollers, which are located between plate 47 and wall 44, on opposite sides of plane P and at a break in groove 48, and define between them a passage aligned with groove 48 and of a section approximately equal to but no larger than the section of filter portions 2. Rollers 50 are fitted to respective shafts 51 perpendicular to and extending through bottom wall 44, and which are fitted, inside cup-shaped body 42, with respective pulleys 52.

Conveying device 46 also comprises two counter-rotating rollers 53 defined by grooved accelerating rollers, which are located, downstream from rollers 50, between plate 47 and wall 44, on opposite sides of plane P and at a further break in groove 48, and define between them a passage aligned with groove 48 and of a section approximately equal to but no larger than the section of filter portions 2. Rollers 53 are fitted to respective shafts 54 perpendicular to and extending through bottom wall 44, and which are fitted, inside cup-shaped body 42, with respective pulleys 55 smaller in diameter than pulleys 52.

Conveying device 46 also comprises an actuating device 56 housed inside cup-shaped body 42, and which comprises a single belt 57 driven by a normally electric motor 58 carried by cup-shaped body 42. Belt 57 is looped about pulleys 52 and pulleys 55 to impart to rollers 50 a peripheral speed V1 substantially equal to the travelling speed of filter portions 2 through input 10, and to rollers 53 a peripheral speed V2 greater than V1.

Figure 12:
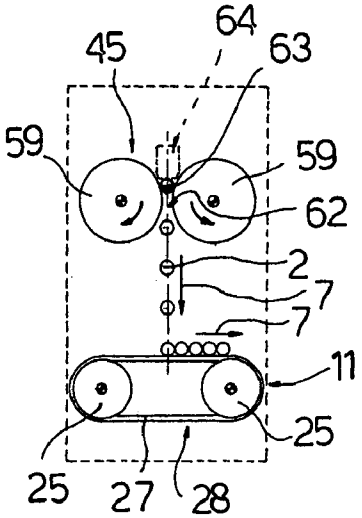
FIGS. 10, 11 and 12 show larger-scale side, plan, and front operating diagrams respectively of the FIG. 3-5 detail.

Conveying device 45 comprises two side by side counter-rotating rollers 59, at least one of which is connected directly to the output of a normally electric motor 60 carried by cup-shaped body 42. Rollers 59 are mounted between front wall 37 and intermediate partition 38 of frame 32 of box 31 to rotate about respective axes 61 located on opposite sides of plane P, parallel to direction 6, and defining a horizontal plane perpendicular to plane P. Rollers 59 are at least as long as a filter portion 2, and define between them a channel 62, which is a feed channel for feeding filter portions 2 to output 11 in direction 7, is of minimum width approximately equal to but no greater than the diameter of a filter portion 2, and comprises a wide input portion defining a seat 63 (FIG. 12) aligned with hole 49 and for receiving a filter portion 2 travelling in direction 6 through hole 49.

A deflecting member 64, lying in plane P, is associated with conveying device 45, and comprises an arm 65 having a curved underside rib 66 and hinged to the top of front wall 37 of frame 32 of box 31 to rotate, in plane P and about an axis perpendicular to plane P, between a substantially vertical raised rest position (FIG. 8), and a lowered operating position in which arm 65 is positioned over and along seat 63, with rib 66 engaging a front portion of seat 63.

In the closed operating position shown in FIGS. 6 and 8, box 31 is positioned with the rear end of bottom wall 41 contacting end plate 14 of frame 12; with the input end of groove 48 adjacent to input 10 to allow the filter portions 2 travelling successively in direction 6 and at speed V1 along conduit 8 to successively engage groove 48 and be engaged by rollers 50; with intermediate partition 38 coplanar with front wall 16 of frame 12; and with conveying device 45 directly over rollers 25 of conveyor 28.

On receiving a filter portion 2, rollers 50 feed it, still in direction 6 and at speed V1, between rollers 53 which, given their faster peripheral speed V2, accelerate it in direction 6, detach it from the following filter portion 2, and feed it completely through hole 49 into seat 63 before the next filter portion 2 engages rollers 53.

On entering seat 63, each filter portion 2 is deflected transversely on contacting rib 66 of deflecting member 64—obviously in the lowered operating position—and moves gradually in direction 7, is pushed by rollers 59 into channel 62, and then falls by force of gravity in direction 7, i.e. crosswise to its own axis, onto conveyor 28, which continues feeding it in direction 7 to hopper 3 of filter assembly machine 4.

When a number of side by side modules 5 are used, as in the FIG. 1 example, conveyors 28 of modules 5 are located adjacent to one another and operate in series to define a movable bottom wall of an input portion of a conveying channel 67, which comes out inside hopper 3 through a hole 68 formed in a lateral wall 69 of hopper 3, and feeds a mass of filter portions 2 into hopper 3 in direction 7.

Figures 3, 4, 5:
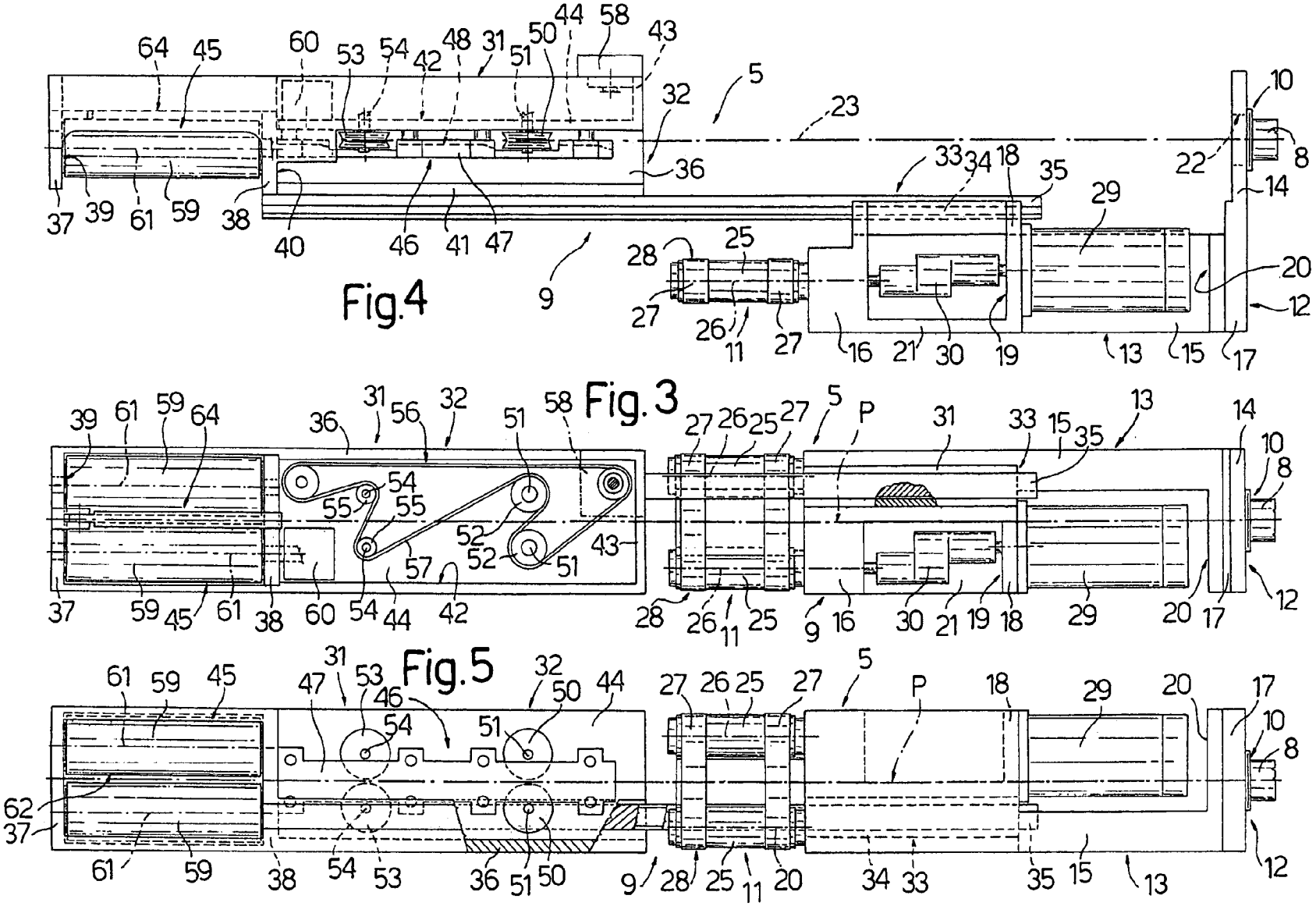
FIGS. 3, 4 and 5 show, with parts removed for clarity, larger-scale plan, side, and underside views respectively of a detail of FIG. 2 in an open position.

Whenever, for any reason, such as jamming, work is required on a module 5, box 31 of deflecting device 9 of module 5 is extracted and moved into the open position shown in FIGS. 3 to 5. By operating a consent switch (not shown) or releasing a known fast-fit connection (not shown) interposed between frames 12 and 32, extraction of box 31 automatically deactivates relative motors 58 and 60, and cuts off air supply along relative conduit 8. In this connection, it should be pointed out that, when a number of modules 5 are used, the modules 5 not involved in the above operation all continue running normally, together with conveyor 28 of the module 5 involved.

As shown in FIG. 4, the length of the rod defining slide 35 is such that, when box 31 is fully open, the rear end of box 31 is located to the front of the front side of conveyor 28, so that, by lifting deflecting member 64, without removing any parts, and also by virtue of guide-slide coupling 33 being offset laterally with respect to plane P, all the component parts of conveying devices 45 and 46 are accessible directly from the outside, so that, any operator intervention is relatively straightforward and fast, and, above all, does not involve a complete shutdown of unit 1 if more than one module 5 is used.

Figure 13:
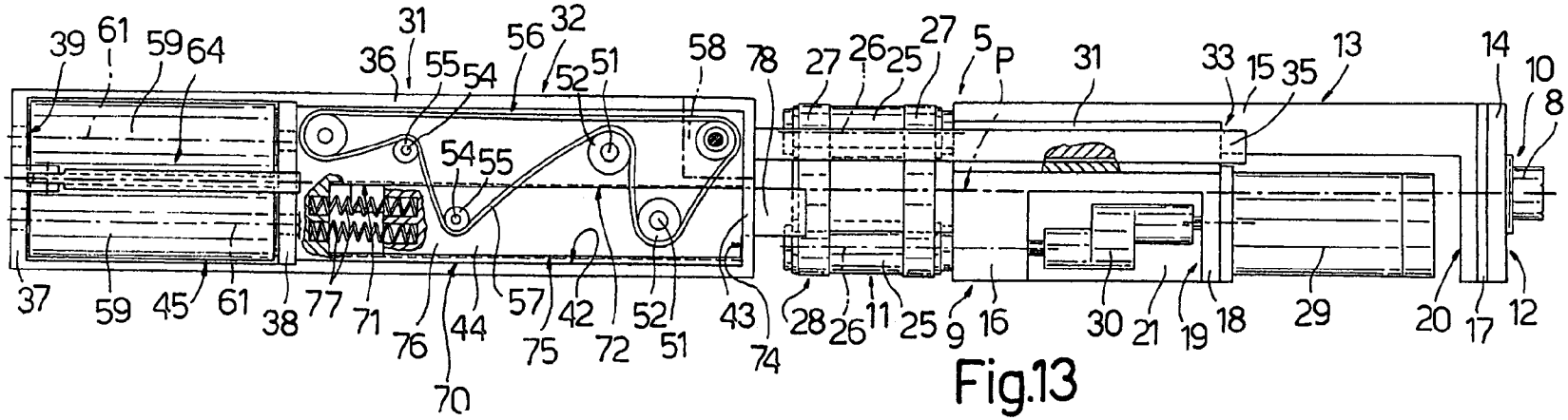
FIGS. 13 and 14 show the same views as, and a variation of, FIGS. 3 and 5.
Figure 14:
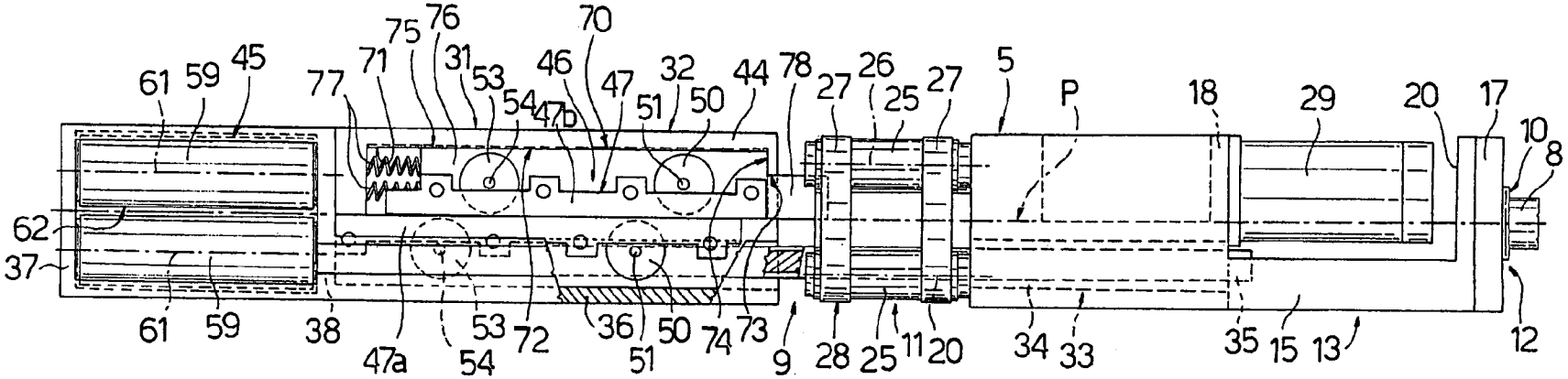

In the FIGS. 13 and 14 variation of unit 1, box 31 comprises a decoupling device 70 for separating each roller 50, 53 from the other roller 50, 53 and so simplifying maintenance when box 31 is opened.

For this purpose, a substantially rectangular longitudinal slot 71 is formed on bottom wall 44 of cup-shaped body 42, on the opposite side of plane P to slide 35, and comprises a wide front portion 72; and a narrow rear portion 73 which extends beneath rear wall 43 of cup-shaped body 42, is open at the rear, and is connected to wide portion 72 by an inner shoulder 74. A slide plate 75 is located inside slot 71, is substantially the same length as slot 71, and comprises a wide front portion 76, which supports shafts 51 and 54 of rollers 50 and 53 on the opposite side of plane P to slide 35, is connected in sliding manner to wide portion 72, but is shorter in length than wide portion 72, and is movable towards shoulder 74 by two springs 77; and a narrow portion 78 connected in sliding manner to narrow portion 73 and terminating, when springs 77 are compressed, flush with the outer rear surface of rear wall 43 of cup-shaped body 42.

Similarly, plate 47 is divided longitudinally along plane P into two portions 47*a* and 47*b*, of which portion 47*a* is fixed, while portion 47*b* is integral with plate 75.

In actual use, when box 31 is closed, contact between the rear end of narrow portion 78 and end plate 14 of frame 12 keeps rollers 50 and 53 and plate 47 in the FIGS. 3 and 5 configuration. Conversely, when box 31 is open, plate 75 is slid back by springs 77 against shoulder 74 to offset the rollers in each pair of rollers 50 and 53, so that any filter portions 2 can be extracted easily, and belt 57 is loosened for easy replacement.

In the FIG. 15 variation of unit 1, modules 5, hereinafter indicated 5*a*, are superimposed and turned 90° with respect to modules 5 in FIG. 1, and are connected individually to hopper 3 by respective output conduits 79 which come out inside hopper 3 through respective holes 68 formed in lateral wall 69 of hopper 3.

Figure 15:
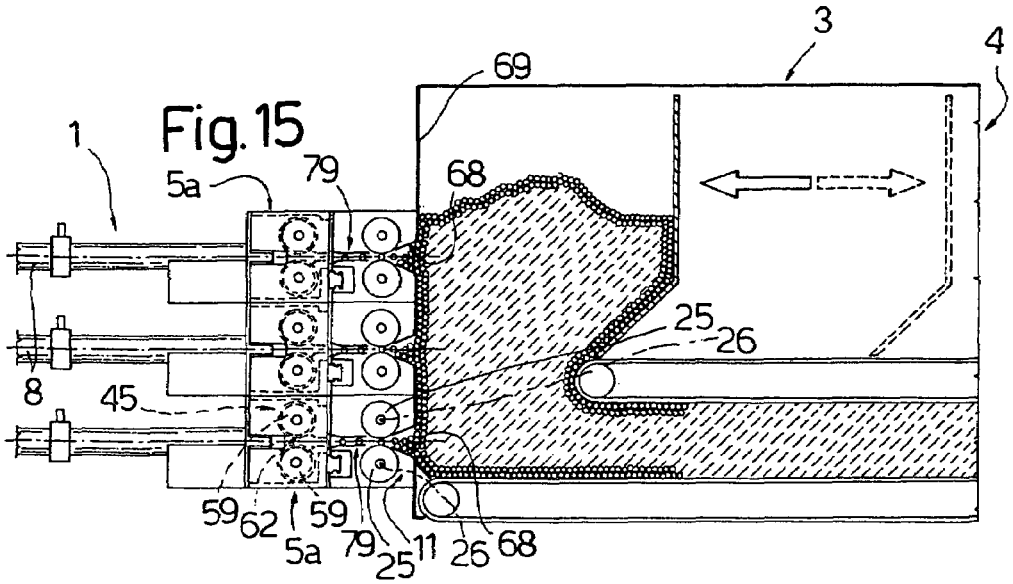
FIG. 15 shows a schematic front view of a second preferred embodiment of the filter feed unit according to the present invention.

The only difference between module 5 in FIG. 1 and module 5*a* in FIG. 15 substantially lies in the output conduit 79 of module 5*a* being a horizontal conduit, the input portion of which is connected directly to the output of channel 62 defined by the two rollers 59, an output portion of which is connected to relative hole 68, and an intermediate portion of which is defined by the two rollers 25, which are substantially identical with rollers 59, are driven by motor 29 to rotate in opposite directions, are located on opposite sides of output conduit 79, and their axes 26 lie in a vertical plane parallel to the vertical plane defined by axes 61 of rollers 59.

The invention claimed is:

1. A unit for feeding filters to a filter assembly machine, the unit (1) comprising:

a deflecting device (9) having an input (10), through which at least one succession of filter portions (2) travelling in an axial first direction (6) is fed, and an output (11) for said filter portions (2) travelling to the filter assembly machine (4) in a transverse second direction (7) crosswise to the filter portions (2); and supply means (8) for feeding said succession of filter portions (2) through said input (10) in said first direction (6);

wherein said deflecting device (9) comprises a fixed frame (12) housing said input (10) and said output (11); and an extractable box (31) fitted to said frame (12) and housing first conveying means (46) for conveying said filter portions (2) in said first direction (6), second conveying means (45) for conveying said filter portions (2) in said second direction (7), and deflecting means (64) located between said first and said second conveying means (46, 45) to divert said filter portions (2) to said second direction (7);

said box (31) being movable, on said frame (12), between a closed operating position, in which said first conveying means (46) are connected to said input (10) and said second conveying means (45) are connected to said output (11), and an open maintenance position, in which said first conveying means (46) are separated from said input (10), said second conveying means (45) are separated from said output (11) and all the component parts of said first and second conveying means (45, 46) are accessible directly from the outside.

2. A unit as claimed in claim 1, wherein said box (31), when in said open position, is frilly extracted from said frame (12).

3. A unit as claimed in claim 1, wherein said box (31) is movable, on said frame (12), between said open and closed positions in said first direction (6) in which said filter portions (2) are fed through said input (10).

4. A unit as claimed in claim 1, and comprising a guide-slide coupling (33) extending in said first direction (6) in which said filter portions (2) are fed through said input (10); said guide-slide coupling (33) being interposed between said frame (12) and said box (31), and being located laterally with respect to said first and second conveying means (46, 45).

5. A unit as claimed in claim 4, wherein said guide-slide coupling (33) is a recirculating-ball coupling.

6. A unit as claimed in claim 1, wherein said first conveying means (46) comprise a slide plate (47) for allowing said filter portions (2) to advance in said first direction (6); feed means (50) for feeding said filter portions (2) along said slide plate (47) at a first speed; and accelerating means (53) for feeding said filter portions (2) to said second conveying means (45) in said first direction (6) and at a second speed greater than said first speed.

7. A unit as claimed in claim 6, wherein said feed means (50) comprise a pair of counter-rotating first rollers (50) supported by said slide plate (47); said accelerating means (53) comprise a pair of counter-rotating second rollers (53) supported by said slideplate (47); and actuating means (56) are fitted to said box (31) to impart to said first and second rollers (50, 53) peripheral speeds equal to said first and said second speed respectively.

8. A unit as claimed in claim 7, wherein said first and second rollers (50, 53) are located between said slide plate (47) and said actuating means (56); and said slide plate (47) is aligned with said input (10) and interposed between said first and second rollers (50, 53) and said output (11).

9. A unit as claimed in claim 7, wherein said actuating means (56) comprise first pulleys (52), each fitted to a respective said first roller (50); second pulleys (55); each fitted to a respective said second roller (53); and a single powered belt (57) looped about said first and said second pulleys (52, 55); said second pulleys (55) being smaller in diameter than said first pulleys (52).

10. A unit as claimed in claim 8, wherein a decoupling device (70) is fitted to said box (31) to separate a first roller (50) and a second roller (53) from an other first roller (50) and an other second roller (53) respectively.

11. A unit as claimed in claim 10, wherein said decoupling device (70) comprises slide means (75) movable along said box between a first position, in which said first rollers (50) are positioned side by side and said second rollers (53) are positioned side by side, and a second position, in which said first rollers (50) are offset with respect to each other and said second rollers (53) are offset with respect to each other.

12. A unit as claimed in claim 11, wherein elastic means (77) are provided to push said slide means (75) into said second position; said frame (12), when said box (31) is in the closed operating position, cooperating with said slide means (75) to keep the slide means in said first position in opposition to said elastic means (77).

13. A unit as claimed in claim 1, wherein said second conveying means (45) comprise two third rollers (59), at least one of which is powered, and which rotate in opposite directions about respective axes (61) parallel to said first direction (6); said third rollers (59) defining between them a feed channel (62) for feeding said filter portions (2) to said output (11) in said second direction (7); and said feed channel (62) having an input portion (63) aligned with said input (10) and for receiving a said filter portion (2) positioned parallel to said axes (61).

14. A unit as claimed in claim 13, wherein said deflecting means (64) comprise an arm (65) lying in a plane (P) parallel to the axes (61) of said third rollers (59), partly engaged inside said feed channel (62), and sloping towards said output (11).

15. A unit as claimed in claim 14, wherein said arm (65) is fitted to said box (31) to rotate, with respect to the box (31) and in said plane (P), to and from a rest position in which the arm (65) is fully disengaged from said feed channel (62).

16. A unit as claimed in claim 1, wherein said first and second conveying means (46, 45) respectively comprise a first and second motor (58, 60) carried by said box (31); said motors (58, 60) being powered when the box (31) is in said closed position, and being disconnected when the box (31) is withdrawn from said closed position.

17. A unit as claimed in claim 13, wherein said output (11) is defined by two fourth rollers (25) fitted to said frame (12) and parallel to and facing said third rollers (59); drive means (29), carried by said frame (12), being connected to at least one of said fourth rollers (25).

18. A unit as claimed in claim 17, wherein the axes (61) of said third rollers (59) lie in a horizontal plane; said fourth rollers (25) rotating in the same direction and being located beneath said third rollers (59); at least one endless belt (27) being looped about said fourth rollers (25) to define an output conveyor (28) for said filter portions (2); and said output conveyor (28) being driven by said drive means (29).

19. A unit as claimed in claim 17, wherein the axes (61) of said third rollers (59) lie in a vertical plane; the unit further comprising a horizontal output conduit (79), carried by said frame (12) and for receiving filter portions (2) that are travelling in said second direction (7), and communicating with said feed channel (62) to receive said filter portions (2); wherein said fourth rollers (25) are located on opposite sides of said output conduit (79), define a portion of said output conduit (79), and are driven by said drive means (29) to rotate in opposite directions with respect to each other.

20. A unit as claimed in claim 18, wherein the unit (1) is modular, and comprises a number of identical, side by side modules (5); each said module (5) comprising a relative said deflecting device (9); and the output conveyors (28) of said deflecting devices (9) being located in series to define, beneath the second conveying means (45) of said deflecting devices (9), a single conveying channel (67) for feeding said filter portions (2) in said second direction (7) to an input hopper (3) of said filter assembly machine (4).

21. A unit as claimed in claim 19, wherein the unit (1) is modular, and comprises a number of identical, superimposed modules (5*a*); each said module (5*a*) comprising a relative said deflecting device (9); and the output conduits (79) of said deflecting devices (9) being superimposed, and wherein each respective module is adapted to feed the respective said filter portions (2) in said second direction (7) to an input hopper (3) of said filter assembly machine (4).

* * * * *

UNITED STATES PATENT AND TRADEMARK OFFICE

CERTIFICATE OF CORRECTION

PATENT NO. : 7,240,783 B2
APPLICATION NO. : 10/913227
DATED : July 10, 2007
INVENTOR(S) : Fiorenzo Draghetti et al.

It is certified that error appears in the above-identified patent and that said Letters Patent is hereby corrected as shown below:

In the Claims:

Column 6, line 19, “frilly” should be -- fully --.

Column 6, line 46, “slideplate” should be -- slide plate --.

Column 6, line 57, “(55);” should be -- (55), --.

Signed and Sealed this

Eighteenth Day of December, 2007

JON W. DUDAS
*Director of the United States Patent and Trademark Office*